US007870627B2

(12) United States Patent
Engel et al.

(10) Patent No.: US 7,870,627 B2
(45) Date of Patent: Jan. 18, 2011

(54) METHOD AND APPARATUS TO STRETCH SHOE UPPERS

(76) Inventors: Raymond C. Engel, 2351 Tenaya Dr., Modesto, CA (US) 95354; Barton J. Alcamo, P.O. Box B, Modesto, CA (US) 95354

( * ) Notice: Subject to any disclaimer, the term of this patent is extended or adjusted under 35 U.S.C. 154(b) by 690 days.

(21) Appl. No.: 11/974,770

(22) Filed: Oct. 16, 2007

(65) Prior Publication Data

US 2009/0094857 A1 Apr. 16, 2009

(51) Int. Cl.
*A43D 5/00* (2006.01)

(52) U.S. Cl. ..... 12/115.4; 12/115.2

(58) Field of Classification Search ..... 12/115.2, 12/115.4, 114.2, 114.6
See application file for complete search history.

(56) References Cited

U.S. PATENT DOCUMENTS

| | | | | | |
|---|---|---|---|---|---|
| 2,123,475 | A | * | 7/1938 | Sachs | 12/115.4 |
| 2,983,936 | A | * | 5/1961 | Weiblen | 12/115.4 |
| 5,373,596 | A | * | 12/1994 | Harrell | 12/115.4 |
| 5,507,056 | A | * | 4/1996 | Brown | 12/114.2 |
| 5,732,428 | A | * | 3/1998 | Brown | 12/115.4 |

* cited by examiner

*Primary Examiner*—Ted Kavanaugh
(74) *Attorney, Agent, or Firm*—Tod R. Nissle, P.C.

(57) ABSTRACT

An improved shoe stretching apparatus is configured to facilitate ready operation of the apparatus inside a shoe while minimizing the hand strength required to use the apparatus.

1 Claim, 3 Drawing Sheets

METHOD AND APPARATUS TO STRETCH SHOE UPPERS

This application does not claim priority based on any prior filed patent application.

This invention pertains to shoes.

More particularly, the invention pertains to a method and apparatus to stretch shoe uppers.

In a further respect, the invention pertains to shoe stretching apparatus that includes a pair of jaws to engage and stretch a selected portion of a shoe upper and includes an operatively associated actuating mechanism that fits inside the heel of a shoe.

Shoe stretching apparatus is well known, is typically constructed like a pair of pliers, and includes an elongate pair of members hinged together at a single pivot point to produce a pair of jaws on one side of the pivot point and a pair of handles on the other side of the pivot point. In such shoe stretching apparatus the handles are, in order to provide leverage and enable a user to produce sufficient compressive force when the jaws are closed on a portion of a shoe upper, relatively long. These handles require sufficient hand strength to operate, and extend and are manually operated outside of a shoe.

The prior art shoe stretching apparatus noted above has long existed. There does not appear to be market pressure to change the design of such apparatus, nor does there appear to be any recognition of a design need that would fuel a search for a change in design of such apparatus. The market trend appears to be in favor of retaining prior art shoe stretching apparatus. As a result, it is anticipated that prior patents or articles describing such prior art shoe stretching apparatus will not discuss market pressure or a design need in connection with shoe stretchers of the general type addressed by the invention.

In addition, the knowledge of a skilled artisan appears to comprise the shoe stretching apparatus noted above. Consequently, there does not seem to be motivation for the artisan to consider altering such apparatus.

However, as has been demonstrated many times in the Patent Office, existing apparatus and methods often can be improved by utilizing an unidentified, unanticipated combination which provides functions that are unpredictable in view of the prior art.

Accordingly, it would be highly desirable to provide an improved shoe stretching apparatus and method that would facilitate stretching the uppers of a shoe.

Therefore, it an object of the present invention to provide an improved shoe stretching method and apparatus.

A further object of the invention is to provide a shoe stretching apparatus having an actuating mechanism that requires minimal strength to operate and that can be utilized inside a shoe.

These and other, further and more specific objects and advantages of the invention will be apparent to those of skill in the art from the following detailed description thereof, taken in conjunction with the drawings, in which.

Briefly, in accordance with the invention, I provide an improved apparatus for stretching the upper of a shoe. The apparatus comprises a first generally L-shaped elongate arm having a distal end, a proximate end, a length (L2), and a longitudinal axis (Y); a second generally L-shaped elongate arm operatively associated with the first arm, having a distal end, having a longitudinal axis (L3), and having a proximate end attached to the proximate end of the first arm at a first pivot point (30); a first shoe stretching member mounted on the distal end of the first arm; and, a second shoe stretching member mounted on the distal end of the second arm and cooperatively associated with the first shoe stretching member. The second arm is moveable between at least two operative positions, a first closed operative position with the first and second shoe stretching members adjacent one another, and a second open operative position with the first and second shoe stretching members spaced apart from one another. The first and second arms having a maximum width (W2) when the second arm is in the first closed operative position. The longitudinal axis (L3) of the second arm is generally parallel to the longitudinal axis (L2) of the first arm when the second arm is in the second open operative position. The apparatus also includes an actuating unit to move the second arm from the first to the second operative position. The actuating unit comprises a first displacement member (32) attached to said second arm at a second pivot point (31) spaced apart from the first pivot point (30). The first and second pivot points lie along a line canted at an angle of at least forty-five degrees with respect to the longitudinal axis of the first arm when the second arm is in the second open operative position. The actuating unit also comprises an actuating assembly interconnecting the first displacement member and the first arm to displace the second arm such that the displacement member (32) pivots about the second pivot point; the displacement member (32) is pushed by the actuating assembly in a direction (B) generally toward the distal ends of the arms, and the second arm pivots on the first pivot point to move the second shoe stretching member toward the first shoe stretching member. The actuating unit has a length (L) less than the length (L2) of the first arm; has a width (W) less that the width (W2) of the first and second arms when the second arm is in the second open operative position; and, is sized to fit inside a shoe in the heel of a shoe of a selected size.

Figure 1:
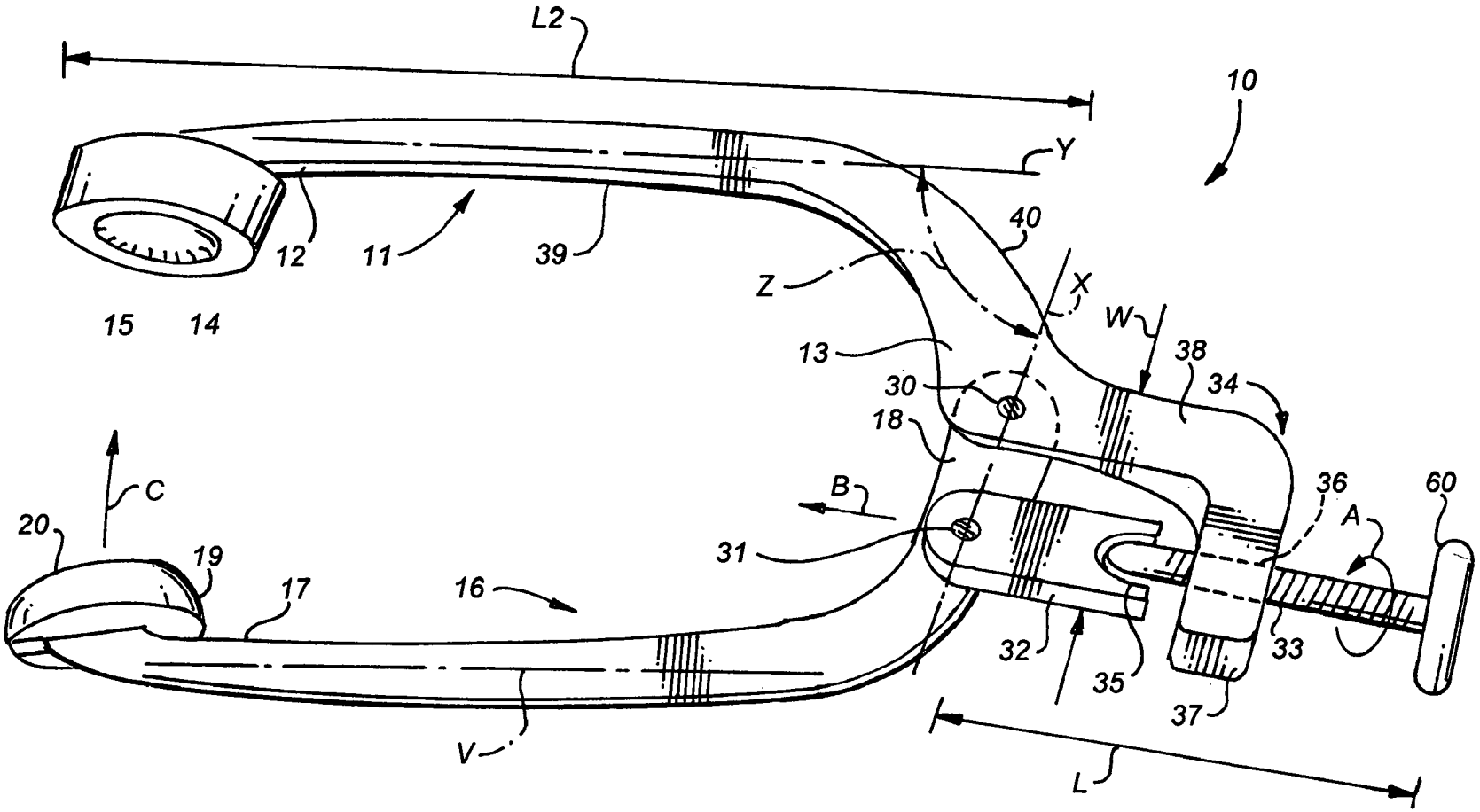
FIG. 1 is a top perspective view illustrating shoe stretching apparatus constructed in accordance with the principles of the invention.

Turning now to the drawings, which depict the presently preferred embodiments of the invention for the purpose of illustrating the practice thereof, and not by way of limitation of the scope of the invention, and in which like characters refer to corresponding elements throughout the several views, FIG. 1 illustrates shoe stretching apparatus constructed in accordance with the invention and generally indicated by reference character 10. Apparatus 10 includes generally L-shaped elongate arm 11 having a distal end 12, a proximate end 13, a length L2, and a longitudinal axis Y. Apparatus 10 also includes generally L-shaped elongate arm 16 operatively associated with arm 11 and having distal end 17, longitudinal axis V, and proximate end 18 attached to proximate end 13 of the first arm 11 at a first pivot point 30. A first shoe stretching member 14 is mounted on the distal end 12 of the first arm 11. A second shoe stretching member 19 is mounted on the distal end 17 of the second arm 16. Convex outer surface 20 of member 19 generally conforms to and will seat in concave arcuate indent 15 formed in member 14.

Figure 2:
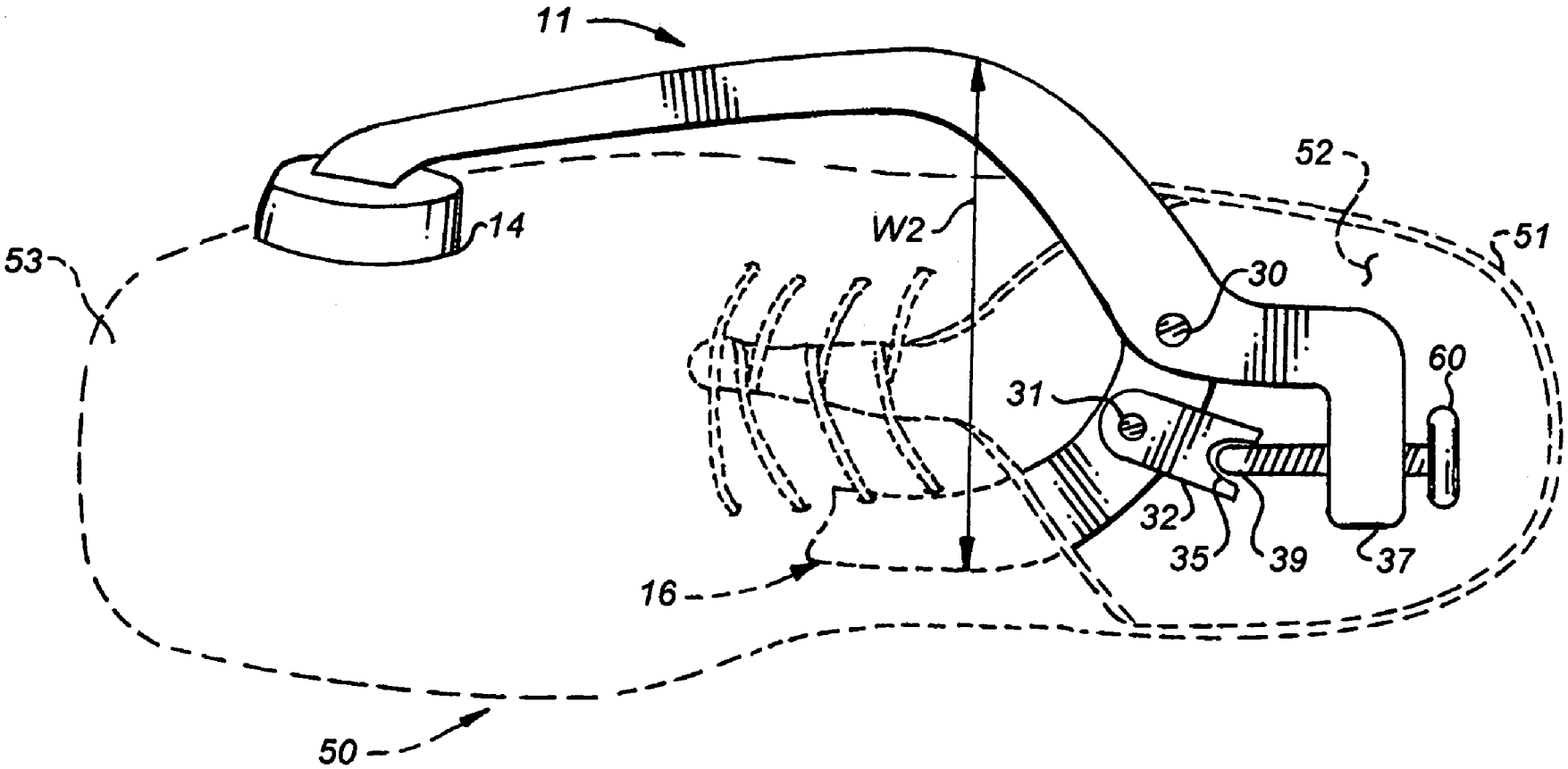
FIG. 2 is a top view illustrating the mode of operation of the apparatus of FIG. 1.

The arm 16 is movable between at least two operative positions, an open operative position illustrated in FIG. 1 and a closed operative position illustrated in FIG. 2. In the closed operative position, arm 16 is displaced toward arm 11 and surface 20 is moved adjacent indent 15. As would be appreciated by those of skill in the art, even though surface 20 is adjacent indent 15 when arm 16 is in the closed operative position, surface 20 ordinarily will not contact indent 15 because a portion of a shoe upper is positioned intermediate surface 20 and detent 15.

When the second arm 16 is in the closed operative position illustrated in FIG. 2, the first and second arms 11, 16 have a maximum width indicated by arrows W2 in FIG. 2.

Although the shape and dimension of arms 11 and 16 can vary as desired, the general L-shape is preferred for arms 11, 16 in the practice of the invention. One leg 40 of L-shaped arm 11 extends outwardly and forwardly to facilitate the arm 11 extending outwardly and around a shoe to a point on the outside of the shoe upper. The other leg 39 of arm 11 extends forwardly to a desired point on the outside of the shoe upper.

The longitudinal axis V of arm 16 is generally parallel to the longitudinal axis Y when the arm 16 is in its second open operative position.

An actuating unit moves the arm 16 from the first to the second operative position. The actuating unit includes a displacement member 32. Member 32 is attached at one end to arm 16 at a pivot point 31 that is spaced apart from pivot point 30. Pivot points 30 and 31 lie along a line X that is canted with respect to the longitudinal axis Y of arm 11 when arm 16 is in the opening operative position illustrated in FIG. 1. The angle Z between line X and axis Y is greater than thirty degrees, preferably greater than forty-five degrees, and most preferably greater than sixty degrees.

While the shape and dimension of an arm 11 may vary, the longitudinal axis of arm 11 extends in a direction the best approximates the centerline of the arm, that coincides with or is parallel to the centerline of arm 11, that is generally parallel to the longitudinal axis of arm 16, and that is generally perpendicular to the direction of travel of members 14 and 19 when arm 16 is moved between its first and second operative positions.

While one end of displacement member 32 is attached to arm 16 at pivot point 31, a groove 35 (FIG. 2) in the other end of member 32 contacts the tip 39 of the externally threaded neck 33 of member 36. Member 36 comprises one component of the actuating assembly that interconnects displacement member 32 and arm 11. L-shaped member 34 comprises the other component of the particular actuating assembly illustrated in FIG. 1. As will be described below, the shape and dimension and construction of the actuating assembly can vary as long as it performs the function of displacing arm 16 such that it pivots about pivot point 30 to move distal end 17 and shoe stretching member 19 in the direction of arrow C toward distal end 12 of arm 11.

L-shaped member 34 includes leg 38 integrated with and fixedly connected to the proximate end 13 of arm 11. Member 34 also includes leg 37. Internally threaded aperture 36 is formed in leg 37 to receive rotatably the externally threaded neck 33.

Turning member 60 in the direction of arrow A in FIG. 1 threads neck 33 through aperture 36 toward member 32 such that tip 39 pushes displacement member 32 in the direction of arrow B in FIG. 1. Pushing member 32 in the direction of arrow B functions to displace the proximate end of arm 16 in the direction of arrow B such that the proximate end 18 turns about pivot point 30 and distal end 17 of arm 16 moves toward distal end 12 of arm 11. Continuing to turn member 60 in the direction of arrow A will move member 19 to a position adjacent member 15. When distal end 17 moves toward distal end 12, arm 16 pivots about pivot point 30 and arm 32 pivots about pivot point 31.

The actuating unit has a length, indicated by arrow L in FIG. 1, which is less than the length L2 of arm 11. The actuating unit also has a width W which is less than the width W2 (FIG. 2) of the first and second arms when the second arm is in the closed operative position. The actuating unit is preferably, although not necessarily, sized to fit in a shoe 50 of selected size in the area 52 inside the heel 51 of the shoe when the apparatus 10 is being utilized to stretch a portion of a shoe upper that is, as illustrated in FIG. 2, located forwardly in the toe 53 of shoe 50. The ability to position the actuating unit inside a shoe 50 is an important feature of the invention and facilitates use of the apparatus 10, as is the use of a handle system that has a length less than that of arms 11 and 16. Another important feature of the invention is the incorporation of dual pivot points 30, 31 which permit a force to be applied at the proximate end of arm 16 to push arm 16 in the direction of arrow B; this construction eliminates the needs for relatively long handles to close arms 11 and 16. The arcuate shape of arms 11, 16 further facilitates use of the invention.

Figure 3:
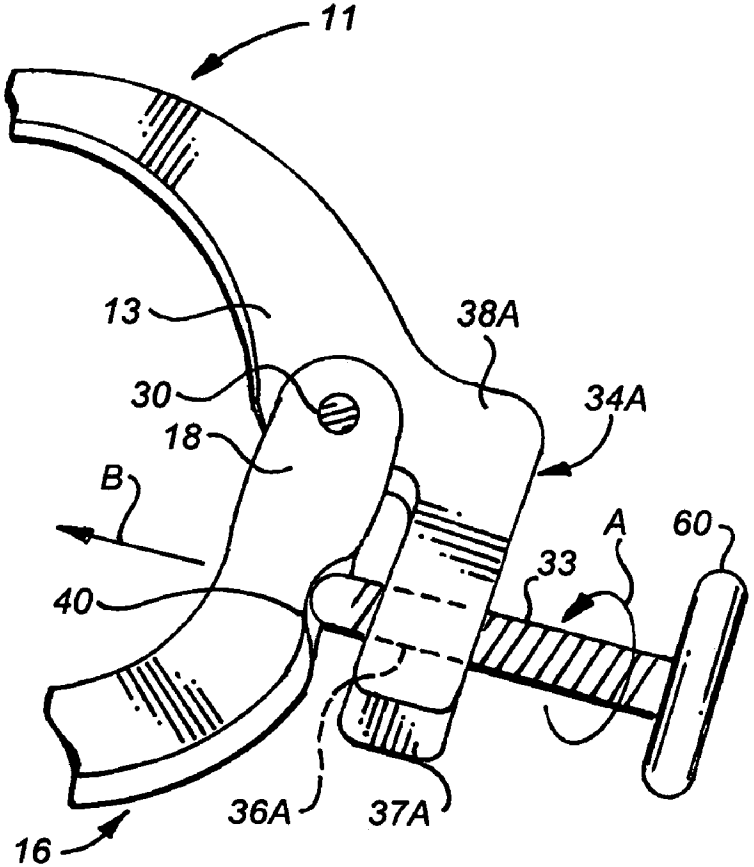
FIG. 3 is a partial top perspective view illustrating another embodiment of the invention; and, FIG. 4 is a partial top perspective view illustrating a further embodiment of the invention.

An alternate actuating unit is illustrated in FIG. 3. In FIG. 3, the displacement member comprises notch 40 formed in the proximate end of arm 16. The actuating assembly includes, as does the actuating assembly in FIG. 1, member 60 with externally threaded neck 33. However, in FIG. 3 the L-shaped member 34 is replaced by L-shaped member 34A. Member 34A includes leg 38A integrated with and fixedly secured to the proximate end 13 of arm 11, and includes leg 37A with internally threaded aperture 36A formed therethrough to receive rotatably neck 33. Turning member 60 in the direction of arrow A moves neck 33 through aperture 36A toward the proximate end of arm 16, and displaces notch 40 and arm 16 in the direction of arrow B to move distal end 17 toward distal end 12 of arm 11.

Figure 4:
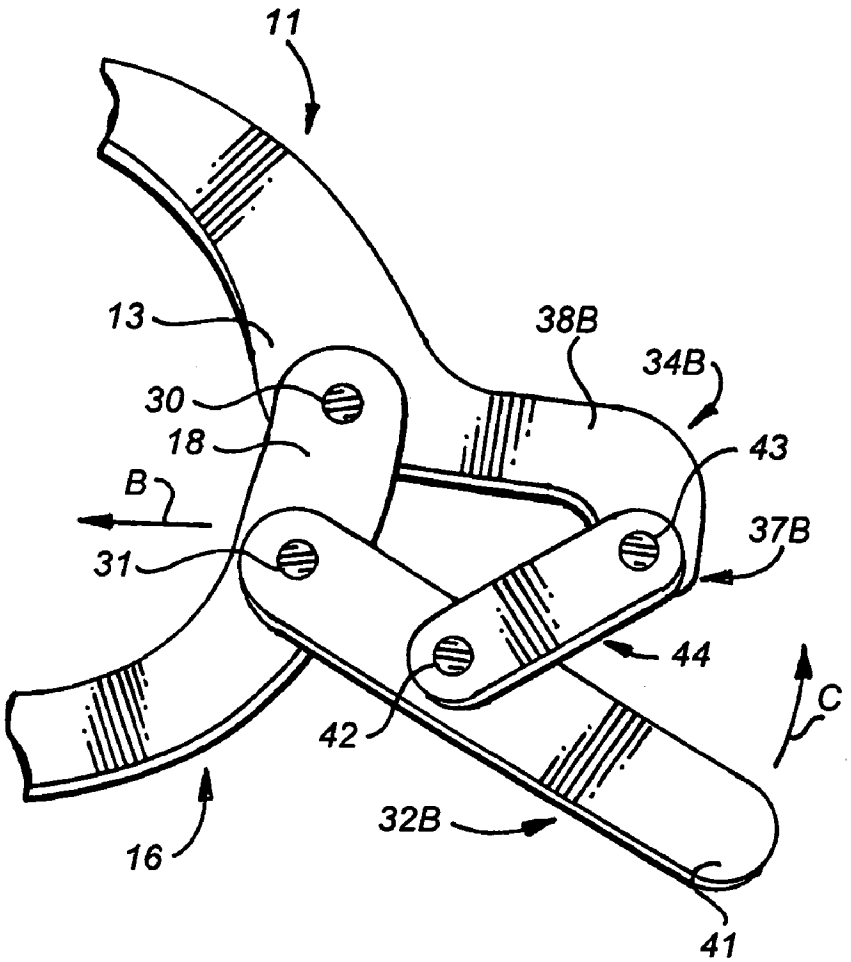

Still another alternate actuating unit is illustrated in FIG. 4 and includes displacement member 32B with a proximate end attached to arm 16 at pivot point 31 and with a distal end 41. The actuating assembly in FIG. 4 includes member 44 and L-shaped member 34B. Member 34B includes leg 38B integrated with and fixedly secured to the proximate end 13 of arm 11, and includes leg 37B. One end of member 44 is attached to member 32B at pivot point 42. The other end of member 44 is attached to member 34B at pivot point 43. When the distal end of member 32B is manually or otherwise moved in the direction of arrow C, displacement member 32B is displaced in the general direction of arrow B and, consequently, the proximate end of arm 16 is displaced in the direction of arrow B so that proximate end 18 pivots about pivot point 30 and distal end 17 of arm 16 moves toward distal end 12 of arm 11.

In use, a shoe 50 (FIG. 2) is provided. A portion of the shoe upper is selected to be stretched. For sake of this example, the portion selected is in the toe of the shoe 50. Apparatus 10 is mounted on shoe 50 such that arm 11 extends (in the manner illustrated in FIG. 2) from a point above and/or in the space 52 circumscribed by heel 51 outwardly around the shoe upper to a point on the exterior of the upper; and, such that arm 16 extends inside the shoe 50. At this point, members 14 and 19 are spaced apart. Member 14 is placed adjacent and contacting the portion of the shoe upper to be stretched. The actuating unit is preferably, but not necessarily, positioned in space 52 circumscribed by heel 51 in the manner illustrated in FIG. 2. Member 60 is turned in the direction of arrow A (FIG. 1) to displace member 32 and the proximate portion of arm 16 in the direction of arrow B so that member 19 moves in the direction of arrow C to a position adjacent member 14 and compresses a portion of the shoe upper between members 14 and 19 to stretch said portion. Apparatus is left in this position, with members 14 and 19 compressing, and hopefully stretching, a portion of the shoe upper. After a desired period of time has passed, member 36 is turned in a direction opposite that of arrow A to permit arms 11, 16 and members 14 and 19 to be separated and apparatus 10 is removed from shoe 50.

Having described my invention in such terms as to enable those of skill in the art to make and use the invention, and having described the presently to make and use of the invention, and having described the presently preferred embodiments thereof.

We claim:

1. Apparatus for stretching the upper of a shoe, comprising (a) a first generally L-shaped elongate arm having
  (i) a distal end,
  (ii) a proximate end,
  (iii) a length (L2),
  (iv) a longitudinal axis (Y);

(b) a second generally L-shaped elongate arm
  (i) operatively associated with said first arm,
  (ii) having a distal end,
  (iii) having a longitudinal axis (L3), and
  (iv) having a proximate end attached to said proximate end of said first arm at a first pivot point (30);

(c) a first shoe stretching member mounted on said distal end of said first arm;

(d) a second shoe stretching member mounted on said distal end of said second arm and cooperatively associated with said first shoe stretching member, said second arm moveable between at least two operative positions,
  (i) a first closed operative position with said first and second shoe stretching members adjacent one another, and
  (ii) a second open operative position with said first and second shoe stretching members spaced apart from one another, said first and second arms having a maximum width (W2) when said second arm is in said first closed operative position, said longitudinal axis (L3) of said second arm generally parallel to said longitudinal axis (L2) of said first arm when said second arm is in said second open operative position;

(e) an actuating unit to move said second arm from said first to said second operative position and comprising
  (i) a first displacement member (32) attached to said second arm at a second pivot point (31) spaced apart from said first pivot point (30), said first and second pivot points lying along a line canted at an angle of at least forty-five degrees with respect to said longitudinal axis of said first arm when said second arm is in said second open operative position,
  (ii) an actuating assembly interconnecting said first displacement member and said first arm to displace said second arm such that
    said displacement member (32) pivots about said second pivot point,
    said displacement member (32) is pushed by said actuating assembly in a direction (B) generally toward said distal ends of said arms, and
    said second arm pivots on said first pivot point to move said second shoe stretching member toward said first shoe stretching member;

said actuating unit (f) having a length (L) less than said length (L2) of said first arm;

(g) having a width (W) less that said width (W2) of said first and second arms when said second arm is in said second open operative position; and, (h) sized to fit inside a shoe in the heel of a shoe of a selected size.

* * * * *